US005802738A

United States Patent [19]

Ferniani

[11] Patent Number: 5,802,738

[45] Date of Patent: Sep. 8, 1998

[54] SANDAL-TYPE FOOTWEAR

[75] Inventor: Aldo Ferniani, Padua, Italy

[73] Assignee: Exo Italia S.r.l., Padua, Italy

[21] Appl. No.: 810,443

[22] Filed: Mar. 4, 1997

[30] Foreign Application Priority Data

Mar. 8, 1996 [IT] Italy ..... PD960014 U

[51] Int. Cl.[6] ..... A43B 3/12

[52] U.S. Cl. ..... 36/11.5; 36/101

[58] Field of Search ..... 36/11.5, 101, 100, 36/45

[56] References Cited

U.S. PATENT DOCUMENTS

| | | | |
|---|---|---|---|
| 3,336,683 | 8/1967 | Schellkopf | 36/11.5 |
| 3,553,754 | 1/1971 | Mendelsohn | 36/11.5 X |
| 3,698,107 | 10/1972 | Fukuoka | 36/11.5 |
| 4,172,330 | 10/1979 | Kao | 36/11.5 |
| 4,477,985 | 10/1984 | Yuan-Hsiang | 36/11.5 |
| 4,525,940 | 7/1985 | Mochizuki | 36/11.5 X |
| 4,535,554 | 8/1985 | De Obaldia B. | 36/11.5 X |

*Primary Examiner*—B. Dayoan
*Attorney, Agent, or Firm*—Guido Modiano; Albert Josif

[57] ABSTRACT

An item of footwear including: a sole having a foot resting part, a tread, and at least one through hole which forms an expanded seat at the tread; an upper; and engagement elements connected to the upper. The engagement elements each have an upper end which is connected to the upper and a lower free end arranged distally from the upper which is shaped so as to pass through and elastically deform a respective through hole to eventually grip in a respective expanded seat for connecting the engagement element to the sole without use of any other coupling device. The upper end of each engagement element is substantially flat and has one side which is substantially non-removably attached to a lateral side portion of the upper by any of stitching, gluing and welding techniques.

14 Claims, 3 Drawing Sheets

SANDAL-TYPE FOOTWEAR

BACKGROUND OF THE INVENTION

The present invention relates to a footwear of the slipper-like, sandal-like, or similar type.

It is known that in the manufacture of low-cost shoes, the structure thereof is decisive as far as both the production costs of the various parts and the final assembly operation are concerned.

Slippers or sandals are currently commercially available wherein a sole produced by injecting relatively soft plastics is assembled together with an upper by gluing.

Accordingly, in order to obtain the product it is necessary to provide all production steps in a single location, and this negatively affects the economy of production, since it is not possible to appropriately choose the production locations where the manufacture of each component is cheapest.

It is also known that there are slippers or sandals wherein the upper is formed by injection-molding thermoplastic materials and monolithically comprises sole coupling elements.

This limits the possible applications exclusively to injection-molded thermoplastic materials.

SUMMARY OF THE INVENTION

A principal aim of the present invention is to provide a shoe which avoids the presence of regions for the mutual gluing of the upper and the sole.

Within the scope of this aim, a consequent primary object is to provide a shoe the structure whereof is composed of elements which can be conveniently produced at different sites and assembled in a single final step in a location that is different from the previous ones.

Another important object is to provide a shoe having a constructively simple structure.

A further object is to provide a shoe which is cheaper than those of the same type which are currently commercially available.

This aim, these objects, and others which will become apparent hereinafter are achieved by a shoe characterized in that it comprises a sole made of plastics and provided with through holes wherein corresponding engagement elements are inserted from the foot resting part towards the tread, said engagement elements being joined to an upper by stitching, gluing, welding, or equivalent means, said engagement elements having free ends which are shaped so as to grip corresponding expanded seats of said holes, which they reach through the elastic deformation of the walls through which they pass.

BRIEF DESCRIPTION OF THE DRAWINGS

Further characteristics and advantages of the present invention will become apparent from the following detailed description of a preferred embodiment thereof and of some additional embodiments, illustrated only by way of non-limitative example in the accompanying drawings, wherein.

DESCRIPTION OF THE PREFERRED EMBODIMENTS

Figure 1:
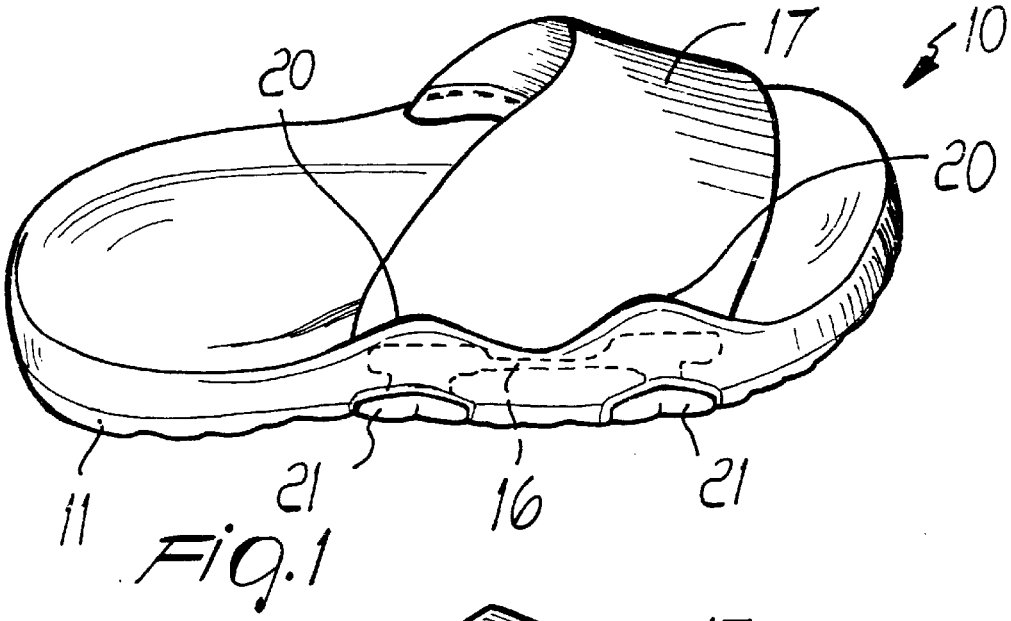
FIG. 1 is a perspective view of the shoe in assembled condition.
Figure 2:
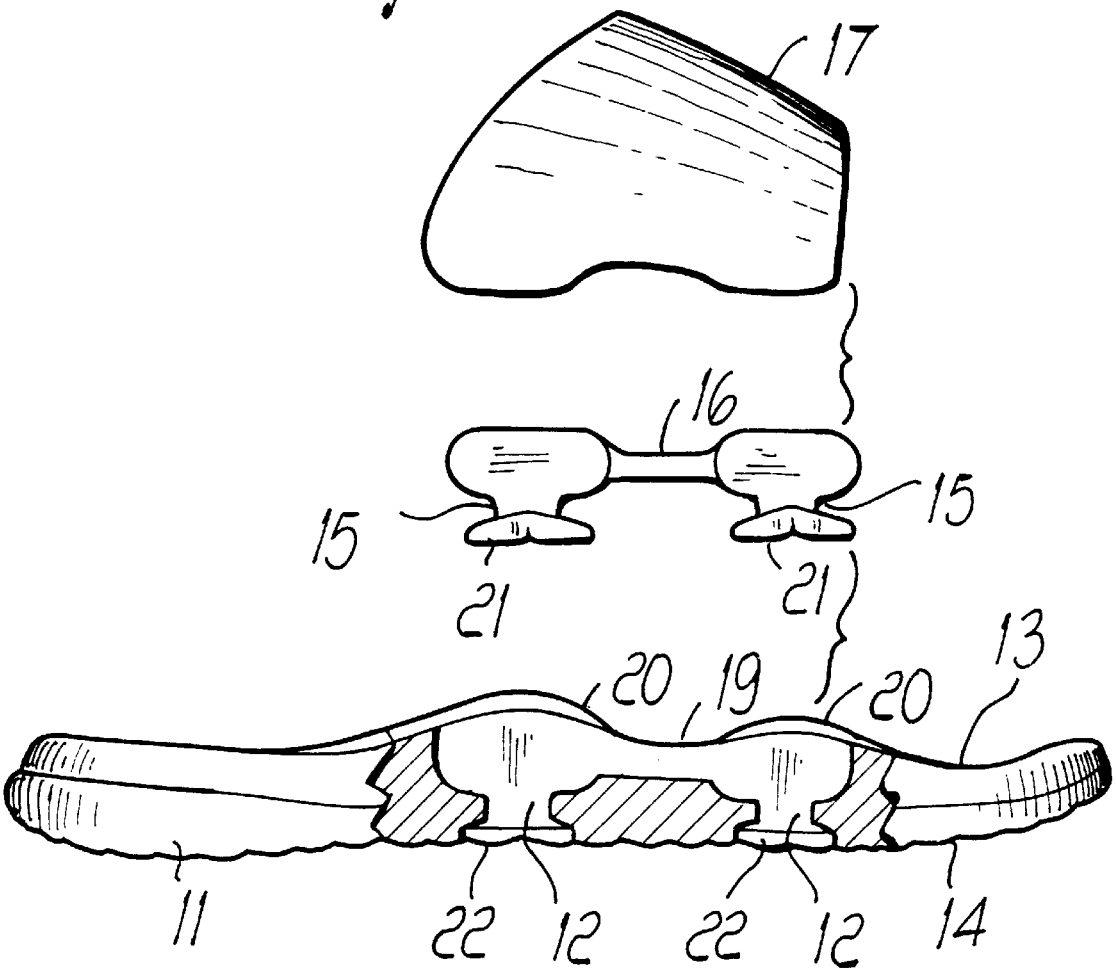
FIG. 2 is a partially sectional exploded view of the shoe of FIG. 1.
Figure 3:
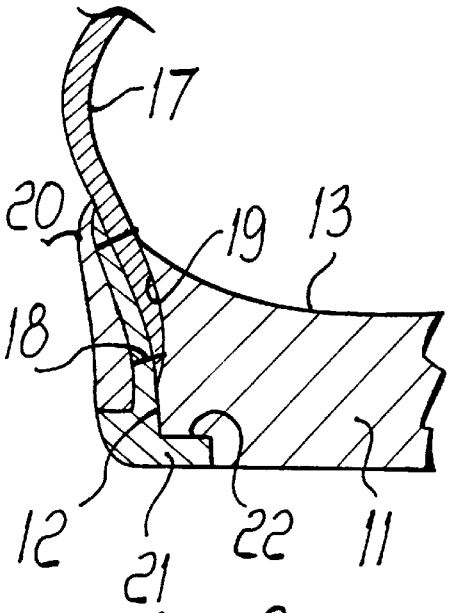
FIG. 3 is an enlarged-scale sectional detail view of he shoe of FIG. 1, taken along a transverse plane.
Figure 4:
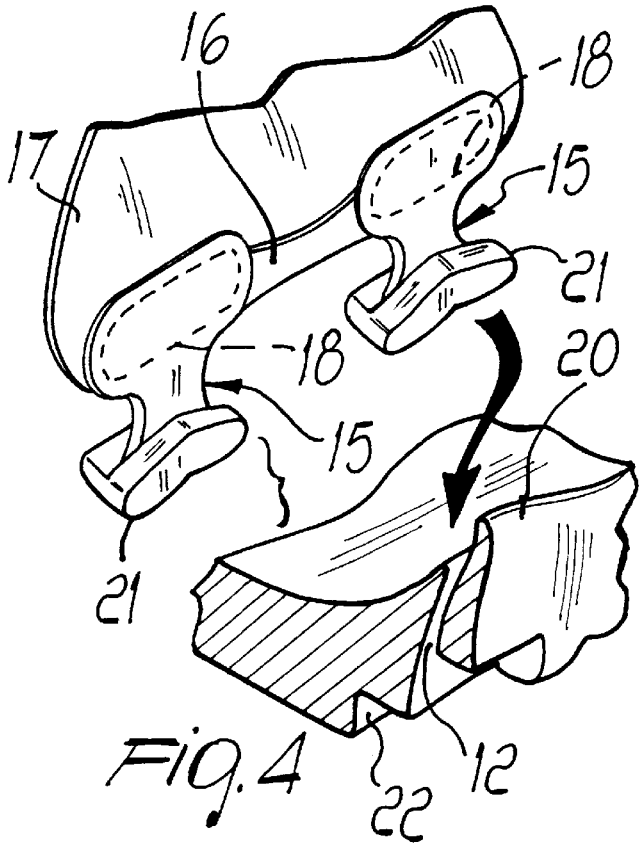
FIG. 4 is an enlarged-scale perspective view of a detail of one of the regions where the upper and the sole are coupled to each other.
Figure 5:
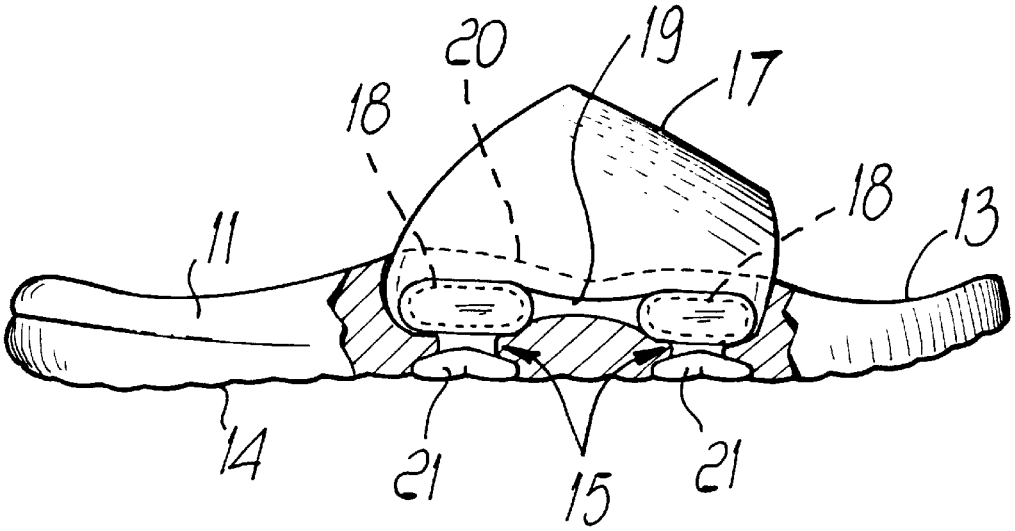
FIG. 5 is a partially cutout side view of the shoe of FIG. 1 in assembled condition.

With reference to the above FIGS. 1 to 5, a slipper having the structure according to the invention is generally designated by the reference numeral 10 and is composed of a sole 11 made of plastics, preferably EVA (ethyl vinyl acetate) or polyurethane or PVC (polyvinyl chloride).

The sole 11 is conveniently formed monolithically by injection-molding of plastic material and has through holes 12 wherein corresponding engagement elements 15 are inserted from the foot resting part 13 towards the tread 14, said elements in this case protruding from a single body 16 which is joined to an upper 17 by means of a plurality of stitches 18.

As an alternative, the coupling can be provided by gluing, ultrasonic welding, molding in place of the elements 15 for engaging the upper 17, or equivalent means.

As shown in the figures, the body 16 is accommodated in a seat 19 formed in the sole 11 which is not visible from outside also because of the presence of perimetric raised borders 20 in the same position.

The regions for coupling to the upper 17 and the stitches 18 are therefore concealed.

The free ends 21 of the engagement elements 15 are expanded in order to grip corresponding expanded seats 22 of said holes 12 which are shaped complementarily thereto and are arranged on the side of the tread 14.

The seats 22 are reached by said ends 21 of said engagement elements 15 by means of the elastic deformation of the walls of the holes 12 through which they pass.

In this case, the engagement elements 15 are made of rigid plastics and again by injection-molding.

The upper 17 can instead be made of soft plastics or of other materials, for example natural or synthetic fabric.

Figure 6:
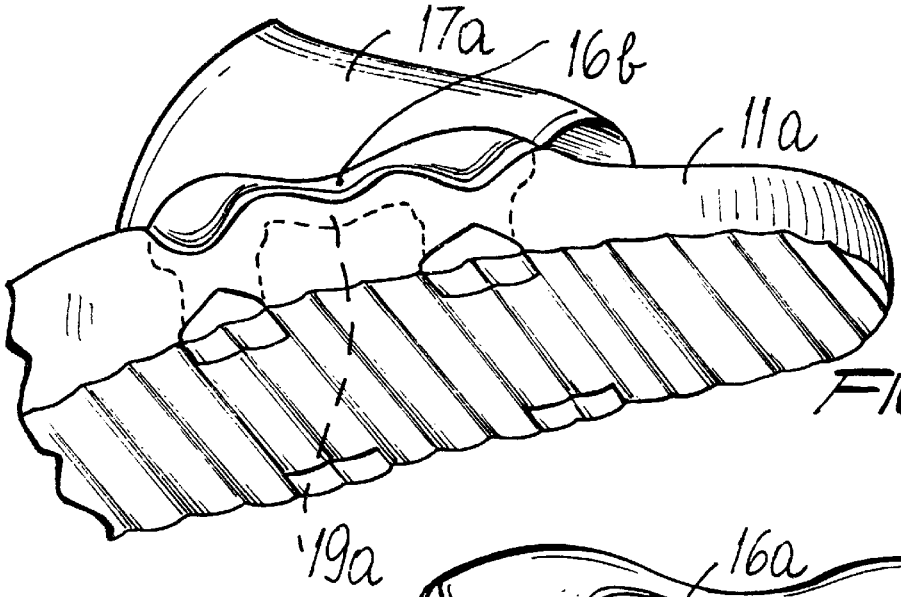
FIG. 6 is a partial perspective bottom view of a different embodiment of the shoe.
Figure 7:
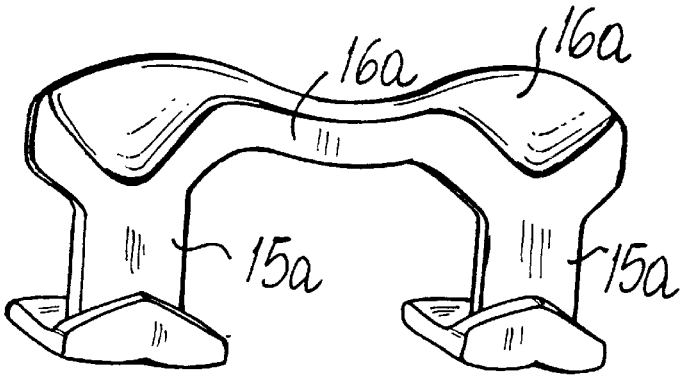
FIG. 7 is an enlarged-scale perspective view of a component of the shoe of FIG. 6.

With reference now to the above cited FIGS. 6 and 7, the engagement elements are now designated by the reference numeral 15*a* and again protrude from a single body 16*a*; the assembly, joined to the upper 17*a*, is assembled to the sole 11*a* in the same manner as above.

In this case, however, parts 16*b* of the body 16*a* are externally visible, since said body is accommodated only partially in a seat 19*a* of the sole 11*a*.

Figure 8:
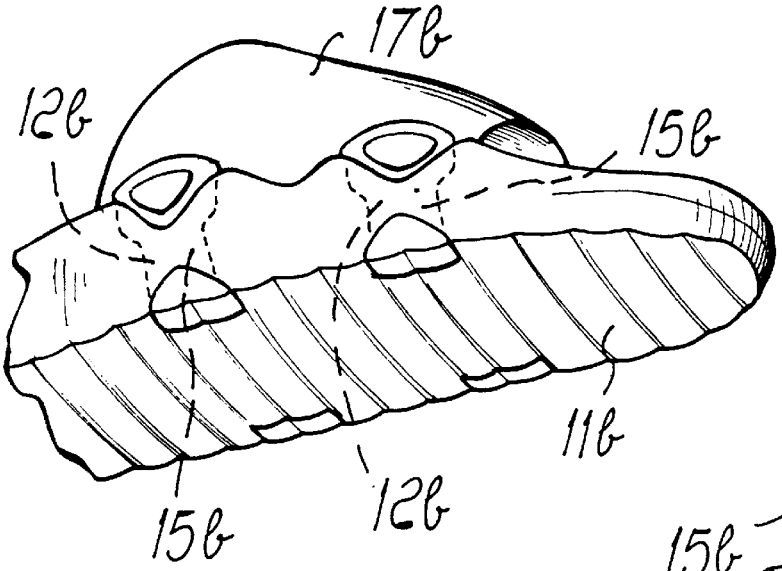
FIG. 8 is a partial perspective bottom view of a third embodiment of the shoe.
Figure 9:
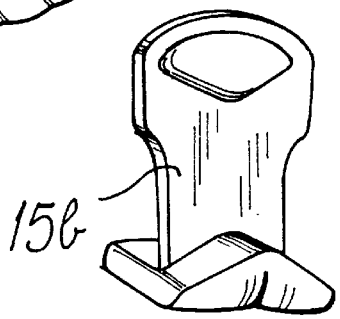
FIG. 9 is an enlarged-scale perspective view of a component of the shoe of FIG. 8.

With reference now to the above cited FIGS. 8 and 9, in a different embodiment the engagement elements, now designated by the reference numeral 15*b*, are individually fixed to the upper 17*b* and are assembled to the sole 11*b* by insertion in through holes 12*b* of said sole.

The coupling between the upper 17*b* and the engagement elements 15*b* is provided in the same manner described above, and as shown in particular in FIG. 8 the elements 15*b* have externally visible upper parts.

In practice it has been observed that the above-described shoe and its various embodiments have achieved the intended aim and objects.

The shoe has no coupling of any kind provided by gluing, welding, stitching between the upper and the sole, since said coupling is provided by the engagement elements 15, 15*a*, and 15*b*.

Assembly in fact entails first the coupling of the upper 17 to the engagement elements 15 (optionally with the cooperation of the body 16 or 16*a*) and then the engagement of the upper 17 to the sole 11.

A plurality of operations currently required to assemble the sole to the upper is thus avoided, allowing a considerable cost reduction.

The fact that each one of the various elements that compose the shoe can be manufactured in a different location and then assembled in an assembly unit provided in a still different location is also considerably important.

This allows to carefully choose the locations that offer lower production costs and lower assembly costs.

Finally, the fact should also be stressed that it is possible to join to the engagement elements 15 uppers of various kinds, for example made of synthetic fabrics, natural fabrics, etcetera.

In practice, the materials employed, so long as they are compatible with the contingent use, as well as the dimensions, may be any according to the requirements.

What is claimed is:

1. An item of footwear comprising:

a sole made of a plastic material, said sole including a foot resting part, a tread and at least one through hole, said through hole forming an expanded seat;

an upper;

at least one engagement element connected to said upper, said engagement element having an upper end which is connected to said upper and a lower free end arranged distally from said upper, said free end being shaped so as to pass through and elastically deform said at least one through hole to eventually grip in said expanded seat for connecting said engagement element to said sole, and said upper end of said engagement element being substantially flat and having one side which is substantially non-removably attached to a lateral side portion of said upper.

2. The item of footwear according to claim 1, wherein said upper end of said engagement element is joined to said upper by any one of stitching, gluing, molding, and welding techniques.

3. The item of footwear according to claim 1, wherein said upper end of said engagement element is concealed by a raised border of said sole so as to be not externally visible.

4. The item of footwear according to claim 1, wherein the free end of said engagement element is expanded for gripping in said expanded seat, said expanded seat being shaped complementarily to said free end, and said expanded seat and a bottom portion of said free end being arranged at the tread.

5. The item of footwear according to claim 1, comprising a plurality of engagement elements and a plurality of through holes with expanded seats, each of said engagement elements being individually fixed to said upper and being assembled to said sole by insertion in a respective one of said through holes.

6. The item of footwear according to claim 1, wherein said free end is shaped so as to pass through and elastically deform said at least one through hole to eventually grip in said expanded seat for connecting said engagement element to said sole without use of any other coupling means.

7. The item of footwear according to claim 1, comprising a pair of engagement elements having upper ends which are mutually interconnected by a longitudinal part to form a single body, said upper ends and said longitudinal part being arranged adjacent said upper and said pair of engagement elements of said single body having lower free ends arranged distally from said upper.

8. An item of footwear comprising:

a sole made of a plastic material, said sole including a foot resting part, a tread and at least one through hole, said through hole forming an expanded seat;

an upper;

at least one engagement element connected to said upper, said engagement element having an upper end which is connected to said upper and a lower free end arranged distally from said upper, said free end being shaped so as to pass through and elastically deform said at least one through hole to eventually grip in said expanded seat for connecting said engagement element to said sole without use of any other coupling means, and said upper end of said engagement element being substantially flat and having one side which is substantially non-removable attached to a lateral side portion of said upper by any one of stitching, gluing, molding, and welding techniques.

9. The item of footwear according to claim 8, wherein said upper end of said engagement element is concealed by a raised border of said sole so as to be not externally visible.

10. The item of footwear according to claim 8, wherein the free end of said engagement element is expanded for gripping in said expanded seat, said expanded seat being shaped complementarily to said free end, and said expanded seat and a bottom portion of said free end being arranged at the tread.

11. The item of footwear according to claim 8, comprising a plurality of engagement elements and a plurality of through holes with expanded seats, each of said engagement elements being individually fixed to said upper and being assembled to said sole by insertion in a respective one of said through holes.

12. The item of footwear according to claim 8, comprising a pair of engagement elements having upper ends which are mutually interconnected by a longitudinal part to form a single body, said upper ends and said longitudinal part being arranged adjacent said upper and said pair of engagement elements of said single body having lower free ends arranged distally from said upper.

13. An item of footwear comprising:

a sole made of a plastic material, said sole including a foot resting part, a tread and at least one pair of through holes, each of said through holes forming an expanded seat;

an upper;

at least one pair of engagement elements connected to said upper, said engagement elements each having an upper end which is connected to said upper and a lower free end arranged distally from said upper, said upper ends of said engagement elements being mutually interconnected by a longitudinal part to form a single body, said upper ends and said longitudinal part being arranged adjacent said upper and said lower free ends of said engagement elements being arranged distally from said upper, each of said lower free ends being shaped so as to pass through and elastically deform a respective one of said through holes to eventually grip in a respective said expanded seat for connecting the respective said engagement element to said sole without use of any other coupling means, and each of said upper ends of said engagement elements being substantially flat and having one side which is substantially non-removably attached to a lateral side portion of said upper by any one of stitching, gluing, molding, and welding techniques, and wherein each of the lower free ends of said engagement elements being expanded for gripping in said respective expanded seat shaped complementarily to the respective lower free end, and said each expanded seat and a bottom portion of each said lower free end being arranged at the tread.

14. The item of footwear according to claim 13, wherein said upper ends of said engagement elements are concealed by a raised border of said sole so as to be not externally visible.

* * * * *